US006191691B1

(12) United States Patent
Serrault

(10) Patent No.: US 6,191,691 B1
(45) Date of Patent: Feb. 20, 2001

(54) REFUSE BIN FITTED WITH A TRANSPONDER

(75) Inventor: Jean-Pierre Serrault, Colombes (FR)

(73) Assignee: Compagnie Plastic Omnium, Lyons (FR)

( * ) Notice: Under 35 U.S.C. 154(b), the term of this patent shall be extended for 0 days.

(21) Appl. No.: 09/415,276

(22) Filed: Oct. 8, 1999

(30) Foreign Application Priority Data

Oct. 13, 1998 (FR) ..... 98 12789

(51) Int. Cl.[7] ..... G08B 13/14

(52) U.S. Cl. ..... 340/572.8; 340/572.9; 340/825.34; 340/825.36; 340/693.5; 177/145

(58) Field of Search ..... 340/572.8, 572.9, 340/571, 693.5, 825.34, 10.3, 825.36; 342/42, 44; 177/145

(56) References Cited

U.S. PATENT DOCUMENTS

| | | | | |
|---|---|---|---|---|
| 4,626,311 | * | 12/1986 | Taylor | 156/308.2 |
| 4,649,397 | * | 3/1987 | Heaton et al. | 343/895 |
| 5,491,483 | * | 2/1996 | D'Hont | 342/42 |
| 5,565,846 | * | 10/1996 | Geiszler et al. | 340/572.2 |
| 5,781,112 | * | 7/1998 | Shymko et al. | 340/10.3 |
| 5,894,268 | * | 4/1999 | McLaren | 340/572.8 |
| 5,947,256 | * | 9/1999 | Patterson | 194/209 |
| 5,969,613 | * | 10/1999 | Yeager et al. | 340/572.9 |
| 5,986,562 | * | 11/1999 | Nikolich | 340/693.5 |
| 5,999,099 | * | 12/1999 | Stobbe | 340/572.8 |

FOREIGN PATENT DOCUMENTS

| | | |
|---|---|---|
| 92 12 243.4 | 9/1992 | (DE) . |
| 43 35 180 A1 | 10/1993 | (DE) . |
| 0 495 947 B1 | 8/1991 | (EP) . |

* cited by examiner

*Primary Examiner*—Benjamin C. Lee
(74) *Attorney, Agent, or Firm*—Schweitzer Cornman Gross & Bondell LLP

(57) ABSTRACT

A bin for collecting refuse, the bin comprising a container having a transponder secured thereto by fixing means. The fixing means are arranged to come into direct contact with the transponder.

6 Claims, 3 Drawing Sheets

REFUSE BIN FITTED WITH A TRANSPONDER

The present invention relates to a bin for collecting refuse, and fitted with a transponder which is secured to the container of the bin by fixing means fastened thereon.

BACKGROUND OF THE INVENTION

The transponder is designed, for example, to enable the bin to be identified by a refuse collection vehicle by interchanging data in manner known per se.

By weighing the bin before emptying, the use can be billed as a function of the quantity of refuse removed.

Various solutions have been proposed for securing the transponder to the bin.

It has been proposed in German utility model (Gebrauchsmuster) 92 12243 to house the transponder, embedded in a block of resin, in a box comprising two shells respectively fastened to opposite faces of a stiffening rib of the bin, each of the shells being provided with a first fixing element passing through the rib via a hole and becoming lodged in a complementary second fixing element made in the other shell.

It has also been proposed in German utility model 94 02392 to insert the transponder in a slot made in the wall of the handling collar of the bin, immediately after the plastics material constituting the container has been molded, and while said plastics material is still soft.

It has also been proposed in European patent 495 947 to dispose the transponder, embedded in a block of resin, in a housing in the bin that is closed by means of a snap-fastened or riveted plate.

The various known solutions are not entirely satisfactory.

In particular, putting the transponder in place in the bin while its constituent plastics material is still fluid requires relatively costly additional equipment to be used in association with the molds used for manufacturing the bin.

In addition, when the transponder is embedded in a block of resin, it is necessary to extract it from the bin before grinding up said bin with a view to recycling, thereby running the risk of mixing together plastics materials that are incompatible from the recycling point of view.

OBJECTS AND SUMMARY OF THE INVENTION

An object of the present invention is to provide a new bin that is easy to recycle and in which the transponder can be put in place without any need for costly equipment.

The bin is of the type in which the transponder is secured to the container of the bin by fixing means fastened to the bin.

In the invention, the fixing means are arranged to come into direct contact with the transponder.

In other words, the transponder can be put in place on the bin without previously being completely embedded in a block of resin.

The fixing means are advantageously made from one or more materials chosen to be compatible, from a recycling point of view, with the plastics material used to make the container.

Thus, as a result of the invention, it is not necessary to extract the transponder before grinding up the bin with a view to recycling, thereby avoiding an operation that can be difficult with known bins.

In a particular embodiment, the fixing means used to secure the transponder to the bin include at least one holding part for insertion in a housing in the bin.

Still in a particular embodiment, the above-mentioned housing is situated under the handling collar of the bin, said housing preferably being open downwards and advantageously presenting a smooth inside surface before the holding part is put in place.

In a preferred embodiment, the fixing means include a box inside which the transponder is housed.

The box advantageously includes a box body and a cover that are snap-fastened together and the transponder preferably includes a printed circuit clamped between the box body and the cover.

The box can be easily put in place on the bin, without any need for costly equipment.

The box body preferably has an annular groove and the cover has a rib designed to snap-fasten in non-releasable manner in the above-mentioned groove.

In a preferred embodiment, the box body is threaded on the outside, and has on its bottom face, accessible from the outside of the bin, projections designed to co-operate with a tool with a view to removing the box if appropriate.

BRIEF DESCRIPTION OF THE DRAWINGS

Other characteristics and advantages of the present invention appear on reading the following detailed description of non-limiting embodiments of the invention, and on examining the accompanying drawings, in which.

MORE DETAILED DESCRIPTION

Figure 1:
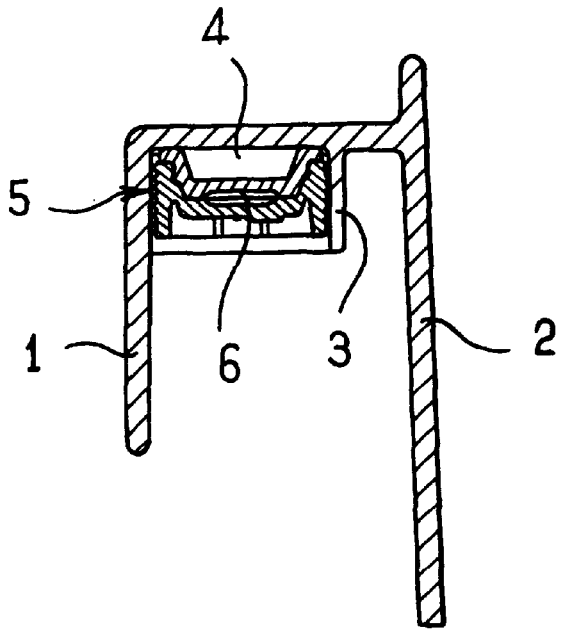
FIG. 1 is a diagrammatic section view showing a transponder in place on a bin, in a first implementation of the invention.

FIG. 1 shows, in vertical section, the handling collar 1 of the container 2 of a bin for collecting refuse.

The container 2 is made of a thermoplastics material such as polyethylene.

Figure 10:
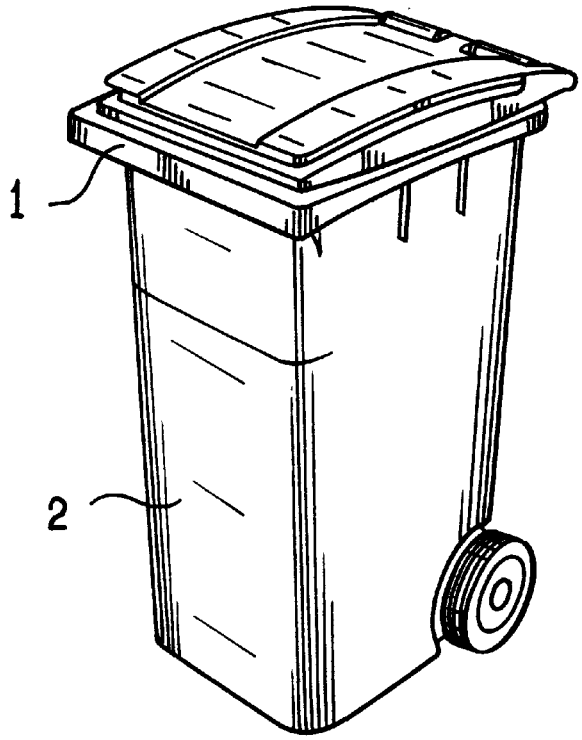
FIG. 10 is a diagrammatic perspective view of a bin of the invention.

The bin is shown in FIG. 10.

The handling collar 1 includes a cylindrical inside wall 3 defining a downwardly-open housing 4 of circular section situated at the opposite side from the hinge of the lid on the container 2 and designed to receive a box 5 housing a transponder 6.

The transponder 6 enables the bin to be identified during collection or during any other operation concerning the management of a stock of bins.

Figure 2:
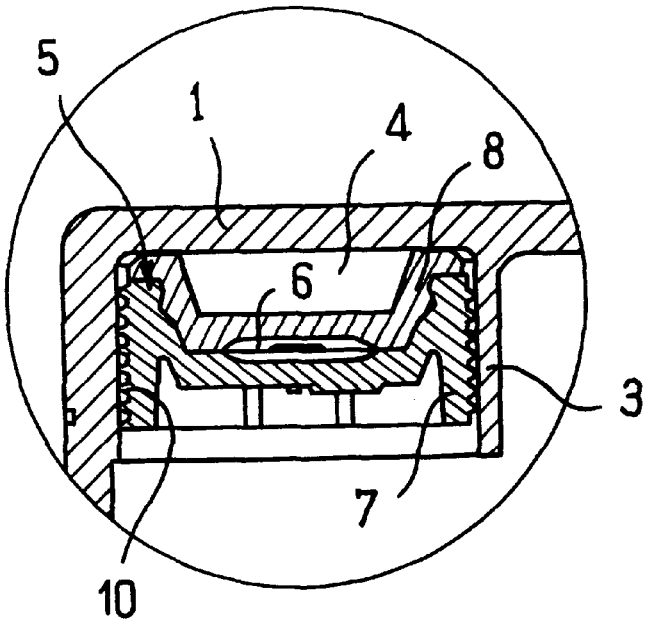
FIG. 2 is a view of a fragment of FIG. 1 on a larger scale.

As can be seen in FIG. 2, the box 5 includes a box body 7 and a cover 8 made of polyethylene.

The box body 7 is shown separately in FIGS. 3 to 6.

The box body 7 includes a base 9 that is fastened at its periphery, at about mid-height, to a tubular skirt 10 of axis X.

The outside surface of the box body 7 has a thread 11.

Figure 3:
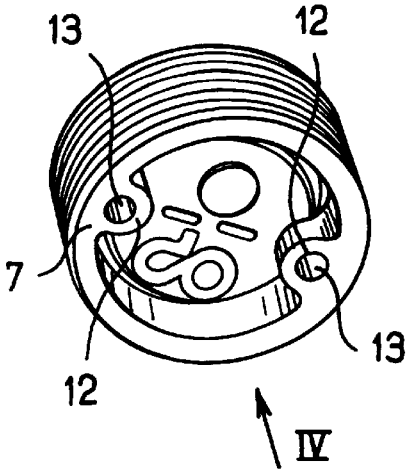
FIG. 3 is a perspective view of the box body as seen from beneath.
Figure 4:
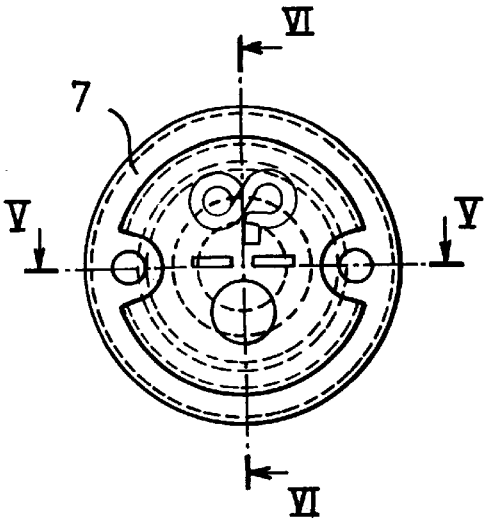
FIG. 4 is a view from beneath along arrow IV of FIG. 3.
Figure 5:
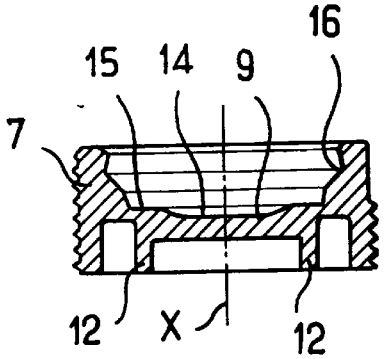
FIGS. 5 and 6 are views on section lines V—V and VI—VI of FIG. 4.
Figure 7:
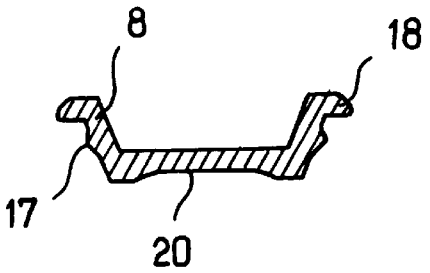
FIG. 7 is a cross-section view of the cover.
Figure 6:
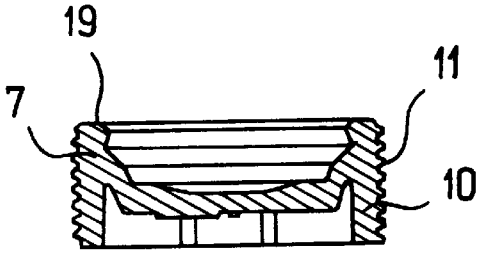
Figure 8:
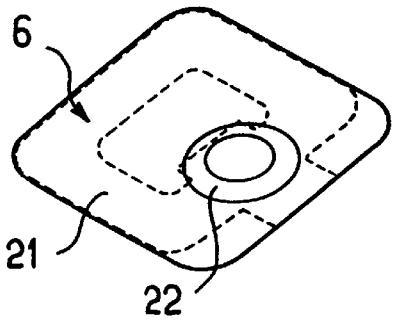
FIG. 8 is a diagrammatic perspective view of the transponder.

As can be seen in FIG. 3, the box body 7 further includes, in its bottom portion, extensions 12 which extend the skirt 10 towards the inside at two diametrically opposite positions and which define two housings 13 enabling the tines of a tool to be inserted with a view to removing the box, as explained below.

The base 9 has, in its central portion, a recess 14 which extends perpendicularly to the axis X.

The recess 14 is fastened at its periphery by a conical surface to a slightly raised annular zone 15 which also extends perpendicularly to the axis X.

The box body 7 includes in its top portion an annular groove 16 made on the inside surface of the tubular skirt 10 and designed for mounting the cover 8.

The cover 8 has a raised edge with a top rim 18 directed radially outwards and designed to be applied on the top section 19 of the box body 7.

The raised edge of the cover 8 is further provided with a rib 17 designed to snap-fasten in the annular groove 16 of the box body 7.

The inside face of the cover 8 has a shallow recess 20.

In the embodiment described, the transponder 6 includes a printed circuit 21 having a conductive track constituting the antenna, and supporting on one face an integrated circuit 22 containing the active electronic components of the transponder 6 protected by an insulating material.

The printed circuit is advantageously covered in a protective varnish.

The base 9 of the box body 7 is dimensioned so that the printed circuit 21 rests on the annular zone 15 when the transponder 6 is in place.

Once the cover 8 is fastened on the box body 7, the printed circuit 21 becomes clamped between the box body 7 and its cover 8, the recesses 14 and 20 providing a space in which the integrated circuit 22 can be housed.

The box 5 is force-fitted into the housing 4 until the cover 8 comes into abutment with the top of the collar 1.

The inside surface of the housing 4 is smooth, thereby facilitating insertion of the box 5.

However, the plastics material constituting the wall 3 yields and penetrates bit by bit between the threads 11, thereby enabling the box 5 to be removed if necessary by unscrewing it by means of the above-mentioned tool.

Figure 9:
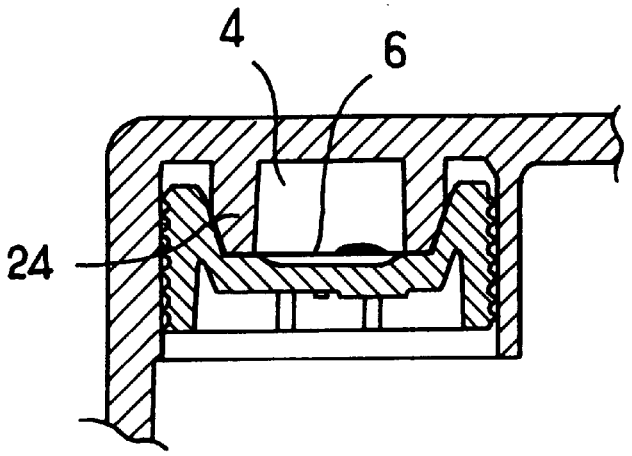
FIG. 9 is a section view, similar to FIG. 2, showing a variant embodiment of the invention.

FIG. 9 shows a variant embodiment in which the top of the housing 4 is provided with projections 24 designed to come into abutment with the transponder 6 when the box body 7 is put in place without the cover 8.

The box body 7 and the cover 8 are made of a thermoplastics material that is compatible, from the recycling point of view, with the plastics material constituting the container 2 of the bin.

In the embodiment examples described, the transponder is completely sheltered from bad weather and it is secured to the bin without play.

As a result of the invention, since the transponder is not embedded in a block of resin, and since it is advantageously held in place by fixing means made of a plastics material that is compatible, from the recycling point of view, with the material of the bin, the bin can be sent for recycling without any need for the transponder to be extracted beforehand.

In addition, the transponder is easily put into place on the bin.

Naturally, the invention is not limited to the above-mentioned embodiment examples, and other fixing means can still be used to secure the transponder to the bin without going beyond the ambit of the present invention.

What is claimed is:

1. A bin for collecting refuse, comprising a container having a transponder secured thereto by fixing means wherein said fixing means comprise a box body inserted in a housing of the bin, said box body being threaded externally and having a bottom face accessible from an outside of said bin and provided with reliefs for the engagement of a tool for unscrewing said box body, and wherein said box body comprises an internal recess for accommodating said transponder in direct contact with said box body.

2. A bin according to claim 1, wherein said fixing means further comprise a cover snap-fastened to said box body, and wherein said transponder includes a printed circuit clamped between the box body and the cover.

3. A bin according to claim 2, wherein the box body has an annular groove and the cover has a rib designed to snap-fasten in said groove.

4. A bin according to claim 1, wherein said housing of the bin is situated under a handling collar of the bin, and wherein said housing is open downwards and has a smooth inside surface.

5. A bin according to claim 1, wherein said fixing means are made from one or more materials chosen to be compatible, from a recycling point of view, with the plastics material used to make the container.

6. A bin according to claim 5, wherein said fixing means are made of polyethylene.

* * * * *